US012473112B2

(12) United States Patent
Meijer et al.

(10) Patent No.: US 12,473,112 B2
(45) Date of Patent: Nov. 18, 2025

(54) FILLING MACHINE PACKAGE WASTE MANAGEMENT

(71) Applicant: Tetra Laval Holdings & Finance S.A., Pully (CH)

(72) Inventors: Magnus Meijer, Malmö (SE); Mattias Darmell, Malmö (SE); Jimmy Liljenberg, Skurup (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 18/563,844

(22) PCT Filed: Apr. 26, 2022

(86) PCT No.: PCT/EP2022/060987
§ 371 (c)(1),
(2) Date: Nov. 22, 2023

(87) PCT Pub. No.: WO2022/248139
PCT Pub. Date: Dec. 1, 2022

(65) Prior Publication Data

US 2024/0228094 A1 Jul. 11, 2024

(30) Foreign Application Priority Data

May 26, 2021 (EP) ..... 21175863

(51) Int. Cl.
*B65B 57/04* (2006.01)

(52) U.S. Cl.
CPC ..... *B65B 57/04* (2013.01)

(58) Field of Classification Search
None
See application file for complete search history.

(56) References Cited

U.S. PATENT DOCUMENTS

| | | | | |
|---|---|---|---|---|
| 4,525,977 | A | 7/1985 | Matt | |
| 2013/0062263 | A1* | 3/2013 | Nakano | B65H 29/62 209/552 |

(Continued)

FOREIGN PATENT DOCUMENTS

| | | | |
|---|---|---|---|
| DE | 10116104 | A1 | 10/2020 |
| EP | 1516820 | A2 | 3/2005 |
| JP | 2020-079114 | A | 5/2020 |

OTHER PUBLICATIONS

International Search Report and Written Opinion for PCT Application No. PCT/EP2022/060987 dated Aug. 11, 2022 in 8 pages.

*Primary Examiner* — Chinyere J Rushing-Tucker
(74) *Attorney, Agent, or Firm* — Knobbe, Martens, Olson & Bear, LLP

(57) ABSTRACT

Methods and apparatus, including computer program products for package waste management in a filling machine. A waste event is detected during operation of the filling machine. The waste event is associated with a waste event detection point in the filling machine and a corresponding web segment position of the packaging material. One or more filled packages to be discarded are identified. The identification is made based on a predetermined distance along a path to be traversed by the packaging material from the waste event detection point to a waste chute of the filling machine. The predetermined distance is expressed in a standardized length measurement format. In response to determining that the web segment position has progressed a distance equaling the predetermined distance, one or more packages formed at or in close proximity to the web segment position are ejected through the waste chute.

19 Claims, 4 Drawing Sheets

(56) References Cited

U.S. PATENT DOCUMENTS

| | | | | |
|---|---|---|---|---|
| 2020/0216204 | A1 | 7/2020 | Ricco' | |
| 2021/0323709 | A1* | 10/2021 | Takemoto | B29C 66/849 |

* cited by examiner

FILLING MACHINE PACKAGE WASTE MANAGEMENT

TECHNICAL FIELD

The present invention relates to package waste management in the context of filling machines.

BACKGROUND

Filling machines are used for packaging products, most commonly food or beverage products, but also other products. The filling machines are used to fill either a bottle or a pouch, depending on the product.

There are several types of filling machines used by the packaging industry. The type of food or beverage filling machine that is used is typically determined by the type of product to be filled, speed requirements, quality and shelf life expectations, resources availability, technology feasibility and many other variables. The types of food products may range from solid to semi-solids, from liquids to frozen, from hot to cold, from free flowing to highly viscous products etc. There are various filling technologies for liquid and dry products, and product filling machines may be rotary or inline, intermittent or continuous motion, semi-automatic or fully automatic with various filling technologies to cater for the huge range of product variables and user requirements, just to mention a few examples. Each type of filling machine offers unique advantages.

In one type of filling machines, a continuous vertical tube is formed from a web of packaging material. The web, which is typically supplied on a roll, is sterilized by applying a sterilizing agent such as hydrogen peroxide, which is subsequently removed, e.g. evaporated by heating, from the surfaces of the packaging material. The sterilized web is maintained in a closed, sterile, environment and is folded and sealed longitudinally to form a tube. The tube is then filled downwards with the sterilized or sterile-processed pourable food product, and is fed along a vertical path to a forming station, where it is sealed at regular intervals to form individual packages. In some embodiments, the packages can subsequently be conveyed to a final folding station where they are folded mechanically into their finished shape, such as a parallelepiped shape.

As the web moves through the filling machine, certain events may occur that may render the resulting package unusable. Such events will be referred to herein as "waste events." A common example of a waste event is when a roll of web runs out and a new roll of web needs to be spliced. This results in double packaging material at the splice, which is generally not permissible in a package, and thus the package formed from the web at the splice position must be discarded. Another example is when a heating element operates outside its normal range, which also results in a package not being approved for use, or when the filling machine is started or stopped, which may cause a package to be in an offset position in the filling machine with respect to the printing on the package, etc.

In order to determine which package(s) to discard, the filling machine uses a so-called "repeat length" that defines the length of a package, based on the web. A package array in the filling machine tracks the packages as distinct units, such that when a waste event (e.g., a splicing event) occurs, the filling machine knows that the waste event occurred at a particular package, say, package 67. As the packages leave the filling machine, a counter determines when package 67 is about to leave the filling machine, and instead of ejecting the package onto a regular conveyor belt along with the other packages, package 67 is ejected through a waste chute. A problem with this method of determining which packages to waste is that the determination may be made only with respect to individual packages. As a result, there may be situations where it is not possible to be sure to what package the waste event belongs (e.g., if a waste event would occur between package 67 or package 68) and as a precaution, more packages than needed may be wasted. Furthermore, whenever the repeat length changes, e.g., when the same filling machine is used for different package types, manual testing must be conducted, which is typically very time and labor intense, and may still result in a situation where more than one package may have to be discarded due to the uncertainty described above. For at least these reasons, there is a need for improved techniques for package waste management.

SUMMARY

It is an object of the invention to at least partly overcome one or more of the above-identified limitations of the prior art. In particular, it is an object to provide methods and systems for package waste management in a filling machine, which results both in fewer packages being wasted and also significantly reduces the testing needed before the filling machine may be put into production of a particular type and size of packages.

According to a first aspect, the invention relates to a method for package waste management in a filling machine. The method includes:

- detecting a waste event during operation of the filling machine, the waste event being associated with a waste event detection point in the filling machine and a corresponding web segment position of the packaging material;
- identifying one or more filled packages to be discarded, wherein the identification is made based on a predetermined distance along a path to be traversed by the packaging material from the waste event detection point to a waste chute of the filling machine, and wherein the predetermined distance is expressed in a standardized length measurement format; and
- in response to determining that the web segment position has progressed a distance equaling the predetermined distance, ejecting, through the waste chute, one or more packages formed at or in close proximity to the web segment position.

On a general level, this invention provides for more efficient and accurate waste management in a filling machine. In particular, by determining distances within the filling machine in a standardized length measurement format (e.g., such as millimeters or centimeters), rather than in discrete packaging units based on a repeat length, it is possible to know with much greater accuracy how far the web needs to travel from a given waste event detection point in the filling machine to the waste chute. This improved accuracy makes it possible to determine with greater accuracy what package(s) is/are affected by the waste event, and thus allows fewer packages to be wasted and more efficient use of the filling machine compared to current solutions.

Another significant benefit of using standardized length measurements is that the waste package determination may be decoupled from the repeat length, as the waste package determination only relies on the standardized length measurements. Thus, the amount of testing needed both during initial setup of the filling machine, or when the filling machine is reconfigured to produce a different type or size of packages, is significantly reduced.

Further, it is possible to configure the filling machine such that one or more packages, formed at or in close proximity to the web segment position, are discarded through the waste chute. For example, if the web segment position for a waste event is clearly located within the perimeters of a package, it may be sufficient for only that one package to be discarded. However, if the web segment position is located close to an edge of a package, it may be a good idea to be cautious and discard both the package itself, and also a previous or a subsequent package. The determination of exactly how cautious one needs to be and what distances between the package edges and the web segment position are tolerable generally depends on the particular situation at hand and lies well within the capabilities of a person having ordinary skill in the art to determine. Further, depending on the type of waste event, a different number of packages may be discarded. Normally, a waste event depends of the size of the component causing the waste event. Thus, some waste events might be only a few millimeters long, which would fit easily within a package. Other waste events, such as a heating element, for example, might be hundreds of millimeters long, resulting in a need to waste several packages.

According to one embodiment, the filling machine is a food product filling machine. The general principles of the package waste management method may be applied to a wide range of products, but are particularly suitable for filling machines that are used to fill packages with food products. It is desirable to minimize food product waste, both from a financial point of view and from global resource and environmental points of view. At the same time is crucial to maintain strict quality and safety standards. These are all objectives that the various embodiments of the invention may help achieve. A food product in this context refers to anything that people or animals ingest, eat and/or drink or that plants absorb, including but not limited to liquid, semi-liquid, viscous, dry, powder and solid food products, drink products, and water.

According to one embodiment, the standardized length measure format is one of: millimeters and centimeters. Using a standardized length measure, such as millimeters or centimeters makes it easy to apply the general principles of the invention in a variety of different filling machines, as the metric system is familiar to essentially everybody and by far the most used one in any research or production setting. Further, the use of millimeters and centimeters typically provide an appropriate level of accuracy in the context of packages. However, it should be realized that of course, rather than expressing measurements in millimeters and centimeters, the same measurements may be expressed in meters, but with a larger number of decimals. Further, it should be noted that the invention is not limited to the metric system. The same principles may also be applied using the imperial system with measurements expressed in inches, for example.

According to one embodiment, the filling machine includes a plurality of modules, and independent waste event detection points are included in one or more of the modules. This modularity and the independence of the waste detection points creates flexibility with respect to detecting waste events in the filling machine, since the waste event detection points do not need to consider data from waste event detection points in any other modules. This yields a high degree of predictability and reproducibility, since a waste event that occurs at a given waste event detection point will generate the same result at the waste chute, independent from waste events that may occur at waste event detection points in other modules, no matter what combination of modules together forms the filling machine. This facilitates configuration and reconfiguration of the filling machine to different situations, and thus allows more flexible use of the filling machine.

According to one embodiment, the predetermined distance is calculated as a sum of distances within each module that the packaging material passes through from the waste event detection point to the waste chute. By defining modules and knowing the distance the web traverses from a waste event detection point within a module to the edge of the module, and by knowing the entire distance the web traverses from an entry point to an exit point of each module, provides sufficient information to calculate the distance from any waste event detection point to the waste chute as the sum of all the individual distances in the different modules traversed by the web. If a module is exchanged or added to the filling machine, the new distance to the waste chute may be easily updated, which again reduces the need for extensive testing and retesting.

According to one embodiment, the predetermined distance is measured either manually in the filling machine or measured automatically on Computer Aided Design (CAD) drawings. In some situations, there may be available CAD drawings, which may be used to determine the distances the web will traverse within, and across, one or more modules. In other situations, especially in the context of existing filling machines, such drawings may not be available, and instead manual measurements may be taken to determine the distance traveled by the web. In yet other situations, it may be useful or necessary to use a combination of manual and CAD drawing measurements. Thus, having these options, along with the modularity of the filling machine, creates significant flexibility in terms of determining the distances traversed by the web through the filling machine from any waste event detection point to the waste chute.

According to one embodiment, the method further includes determining whether to eject one or more packages based on the location of the web segment position with respect to a previous or a subsequent package. As was mentioned above, having a more accurate location for the web segment position makes it possible to determine whether it is sufficient to discard only a single package or whether several packages must be discarded. Typically, such a determination also considers several other factors, such as the type of waste event, the type of food product, various rules and regulations about what is permissible for the food product and the package, etc., and may thus be adapted to the particular situation as needed by a person having ordinary skill in the art.

According to one embodiment, determining that the web segment position has progressed a distance equaling the predetermined distance is made based on data obtained from a rotary encoder in the filling machine. Encoders are commonly used in filling machines and are well known to those of ordinary skill in the art. They may provide very precise information about how much an axle has rotated, and may therefore be used to measure with great accuracy how far the web has moved in the filling machine. By relying on this prevalent technology as the "brain" of the system, consistent and reliable information may be obtained, and it also facilitates integration of the principles of the invention into a variety of existing filling machines that uses encoders.

According to one embodiment, identifying one or more filled packages to be discarded includes determining a correction factor to be applied to the predetermined distance, wherein the correction factor is based on data obtained from the encoder. This correction factor makes it possible to more accurately determine which package(s) should be wasted, depending on when the waste event(s) occur(s). As a result of this more accurate determination, fewer packages may be wasted, leading to a number of financial and environmental benefits in production.

According to a second aspect, the invention relates to a system for package waste management in a filling machine. The system includes a memory and a processor. The memory contains instructions that when executed by the processor causes the processor to perform a method that includes:

detecting a waste event during operation of the filling machine, the waste event being associated with a waste event detection point in the filling machine and a corresponding web segment position of the packaging material;

identifying one or more filled packages to be discarded, wherein the identification is made based on a predetermined distance along a path to be traversed by the packaging material from the waste event detection point to a waste chute of the filling machine, and wherein the predetermined distance is expressed in a standardized length measurement format; and in response to determining that the web segment position has progressed a distance equaling the predetermined distance, ejecting, through the waste chute, one or more packages formed at or in close proximity to the web segment position.

The system advantages correspond to those of the method and may be varied similarly.

According to a third aspect, the invention relates to a computer program product for package waste management in a filling machine. The computer program comprises a computer readable storage medium with instructions to carry out the following steps when executed by a processor:

detecting a waste event during operation of the filling machine, the waste event being associated with a waste event detection point in the filling machine and a corresponding web segment position of the packaging material;

identifying one or more filled packages to be discarded, wherein the identification is made based on a predetermined distance along a path to be traversed by the packaging material from the waste event detection point to a waste chute of the filling machine, and wherein the predetermined distance is expressed in a standardized length measurement format; and in response to determining that the web segment position has progressed a distance equaling the predetermined distance, ejecting, through the waste chute, one or more packages formed at or in close proximity to the web segment position.

The computer program involves advantages corresponding to those of the method and may be varied similarly.

The details of one or more embodiments of the invention are set forth in the accompanying drawings and the description below. Other features and advantages of the invention will be apparent from the description and drawings, and from the claims.

BRIEF DESCRIPTION OF THE DRAWINGS

Like reference symbols in the various drawings indicate like elements.

DETAILED DESCRIPTION

As was described above, a goal with the various embodiments of the invention is to provide methods and systems for package waste management in a filling machine. Rather than operating on a package unit level, the system uses measured distances between waste event detection points and a waste chute expressed in a standardized measurement format, such as millimeters or centimeters. By doing so, it is possible to more accurately determine which packages need to be discarded, which reduces overall waste from the filling machine. Further, by using distances in a standardized measuring format, rather than package units, the filling machine becomes more adaptable to handling various types and sizes of packages, and significantly less testing is needed at setup or reconfiguration of the filling machine, compared to what is currently possible. The system components and their interactions will now be described in further detail by way of example and with reference to the drawings.

Figure 1:
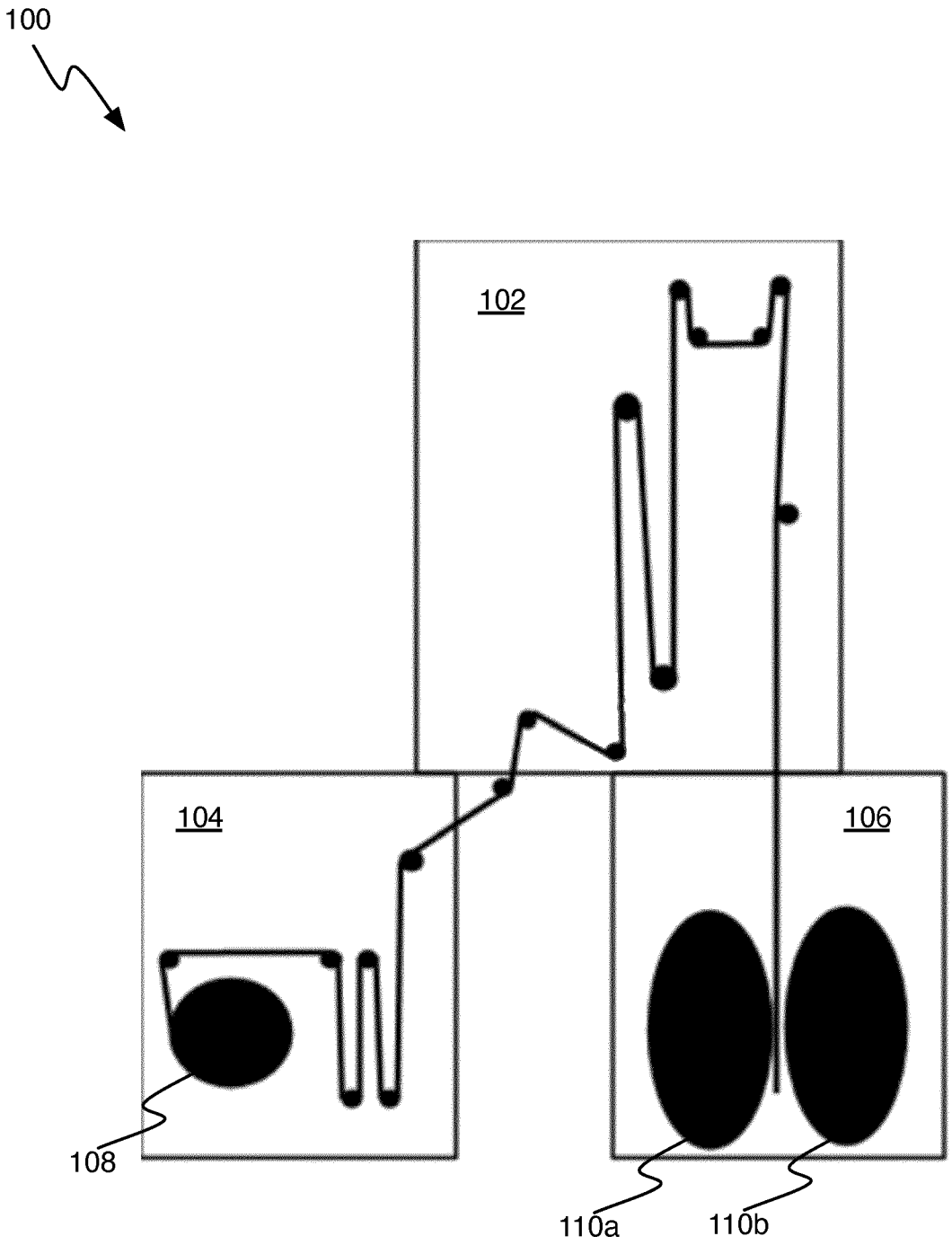
FIG. 1 shows schematic view of a filling machine in accordance with one embodiment.

FIG. 1 shows schematic view of a filling machine 100 in accordance with one embodiment. As can be seen in FIG. 1, the filling machine 100 includes three modules 102, 104 and 106. The first module 104 includes a roll of packaging material 108 (also referred to as "web" herein) to be filled with the food product. The web passes through the different modules 102, 104, 106, where it is processed in different ways (heated, sterilized, etc.) and the tube formed by the web is filled with the food product. In the last module 106 of the filling machine 100, there is a jaw system 110*a-b*, which forms the individual packages.

The jaw system 110*a-b* may be constructed in many ways. In the illustrated embodiment, jaw system 110*a-b* is chain driven, which makes it possible to form packages in one continuous motion. The jaw system 110*a-b* in the shown embodiment includes ten links, and every link creates a package. It should be noted that depending on the package size and volume, there may be fewer or more links in the jaw system 110*a-b*. Also, the links may have different lengths, typically depending of the package repeat length. Irrespective of the number of links and their sizes, when the jaw system 110*a-b* has advanced one link, it has produced one package.

Figure 2A:
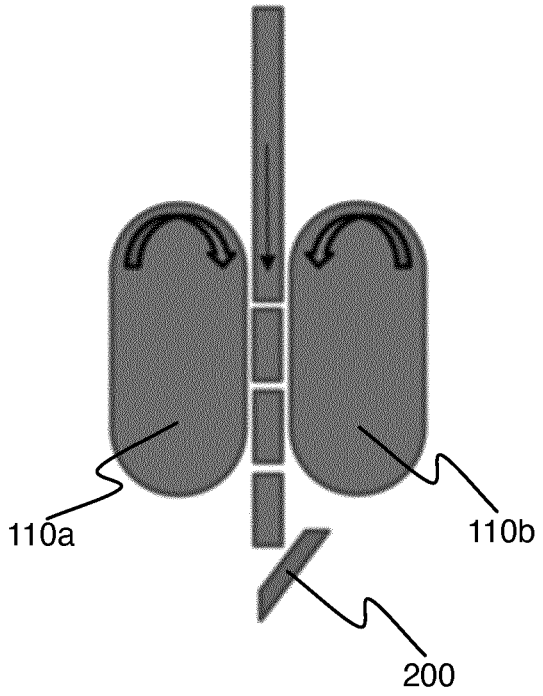
FIGS. 2A and 2B show schematic views of a jaw system of a filling machine, and a waste gate in two different positions, in accordance with one embodiment.
Figure 2B:
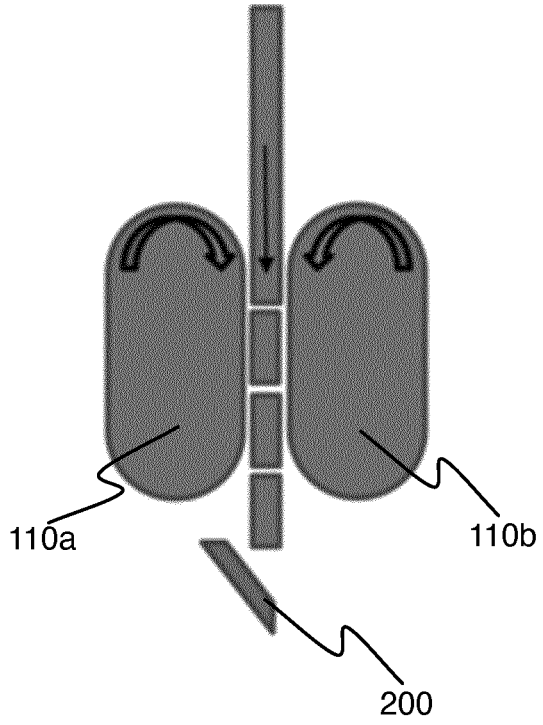

After the individual packages have been formed, they are discharged onto a pneumatic waste gate 200, shown in FIGS. 2A and 2B. In the illustrated embodiment, the waste gate 200 is embodied as a stainless steel plate that is located right below the jaw system 110*a-b* and has two possible positions; a production position that is shown in FIG. 2A, and a waste position that is shown in FIG. 2B. In the production position, the waste gate 200 directs a package coming out of jaw system 110*a-b* of the filling machine 100 onto a production conveyor that takes the package to the next processing step. In the waste position, the waste gate 200 directs a package being discharged from the filling machine into a waste chute.

As the skilled person realizes, it is important not only to keep track of the jaw system 110*a-b* with its links, but also to time the switching of the waste gate 200 between the production and the waste positions, such that a packet ends up in its proper place and such that the switching of the waste gate 200 only occurs in between the arrival of packages at the waste gate 200. In a typical production setting, it is not uncommon for anywhere between 3 and 12 packages or even more to be produced every second, so the timing of the switching of the waste gate 200 must be very precise relative to when the packages arrive at the waste gate.

In one embodiment, to ensure this precise timing, the servo motor in the jaw system 110*a-b* uses an encoder. Encoders are well known to those having ordinary skill in the art and are used to measure how much an axle has rotated, and may therefore be used to measure with great accuracy how far the web has moved in the filling machine. The encoder position is synchronized with the jaw system mechanics in a process referred to as "homing." The homing can basically be described as a calibration process in which the encoder is zeroed at a certain position of the mechanics. This may be done, for example, using a sensor detecting a stainless steel "flag" located on one of the jaws of the jaw system 110*a-b*. After the homing is performed, it is possible to know the exact position of the jaw system 110*a-b* at any given time during operation.

The encoder is programmed such that one link equals 360 encoder units (degrees). That is, when the jaw system has moved 360 degrees, one package cycle has occurred and one package has been produced. This also means that for different package volumes the 360 degrees indicate different distances in terms of millimeters of web moved.

Almost all functionality inside the jaw system 110*a-b* is synchronized with the encoder and repeated for every package produced. For example, a sealing pulse may be triggered every time the encoder passes x degrees, to create a sealing of a package; a printing of a package may be triggered when the encoder passes y degrees, etc.

As was mentioned above, the movement of the waste gate 200 from between the waste and production positions, respectively, may only be done when no package is in the way, otherwise the package might get jammed. This means there is only a small window of these 360 degrees for every link during which the waste gate 200 may actually be moved in order to be in the proper position for the next package to arrive at the waste gate 200. This also means prior to entering this "waste gate possible move window," a decision must be made as to whether the subsequent package should go to production or to waste. When the decision of wasting a package has been made, the package is no longer considered to be inside the filling machine 100, as it is no longer possible to revise the decision about wasting this package.

Figure 3A:
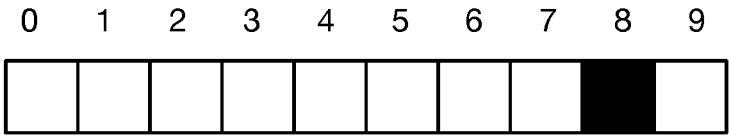
FIG. 3A-3C show schematic views of package arrays containing data about which packages are to be wasted, in accordance with one embodiment.

In order to further explain this decision process, the notion of a "package array" will be introduced. A package array is used in many conventional filling machines 100 for purposes of keeping track of data about every package, as the package is moves through the filling machine 100. Any type of data about a package may be kept in the package array, but for clarity reasons, this discussion will only pertain to data that indicates whether the package should go to production or to waste. FIG. 3A shows an example of a package array having a length of 10 packages, each being represented by an index ranging from 0 to 9, and where the package at index 8 contains a data element, for example, that the package should be wasted. It should be noted that while FIG. 3A only shows a package array representing 10 packages, in a typical filling machine (100) there may be anywhere between 50 and 300 packages at any given time, ranging in volume from 1000 milliliters to 20 milliliters.

In machines that use discrete units, such as cardboard packers, it is relatively straightforward to represent the packages into an array, as the packages are already discrete units. In filling machines, however, this is more difficult as the moving, continuous web of packaging material must be translated into an array with discrete units. The package array is therefore shifted for every package produced, meaning that the information in position 0 of the array reflects the package closest to the waste gate 200. When the filling machine 100 reaches the "decision point" about whether to waste a package, the filling machine 100 checks the information in position 0 of the package array to and see whether the package should be wasted or not. After the decision has been made, the array is shifted and package 0 is no longer in the array (even though it is physically still in the filling machine).

One problem with this arrangement lies in that the package array will be shifted every time one package is produced. However, the waste events may happen at any point in time, and are typically not synchronized with the encoder position or the shifting of the package array. To further illustrate this problem, consider the following example where a filling machine 100 runs 7200 packages per hour. This means 2 packages per second. With a package repeat length of 200 mm, the web is moving at a speed of 400 mm per second. Further, two packages produced per second means that the package array is shifted every 500 ms. Also assume that the shift of this package array is decided to be done at 180 degrees of the encoder.

In current solutions the positions for the specific events are determined during a calibration process by manually testing the filling machine 100. This type of calibration process requires a significant investment manual labor and time. For example, in the event of a paper splice, there is a manual determination that when the sensor detects a splice, it should write to (e.g.) position 56 in the package array that package 56 contains the splice and should therefore be wasted. With a 200 mm repeat length, 56 packages means approximately 11200 mm of packaging material.

Figure 3B:
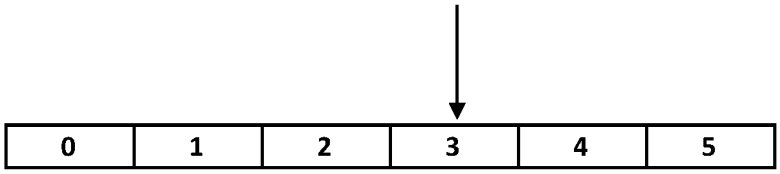
Figure 3C:
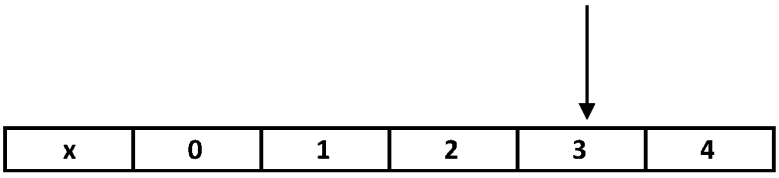

If the encoder position happens to be 179 degrees when the splice is detected, the indication of the splice will end up in a different position in the array, compared to if the position is 181 degrees when the detection is made (i.e., if the array is just about to be shifted, or just has been shifted). This is illustrated in FIGS. 3B and 3C, respectively. FIG. 3B shows a situation where the encoder is at 179 degrees. This means that the waste event is added to package 3, which is located 700.5 mm from the end. FIG. 3C, on the other hand, shows a situation where the encoder is at 181 degrees, i.e., directly after the array has shifted. This means that the waste event is wrongly added to package 3 in the shifted array, which is located 899.5 mm from the end. Thus, a two-degree difference in the encoder results in almost a 200 mm difference in packaging material. Therefore, in order to accommodate for this uncertainty, two packages will need to be discarded.

Figure 4:
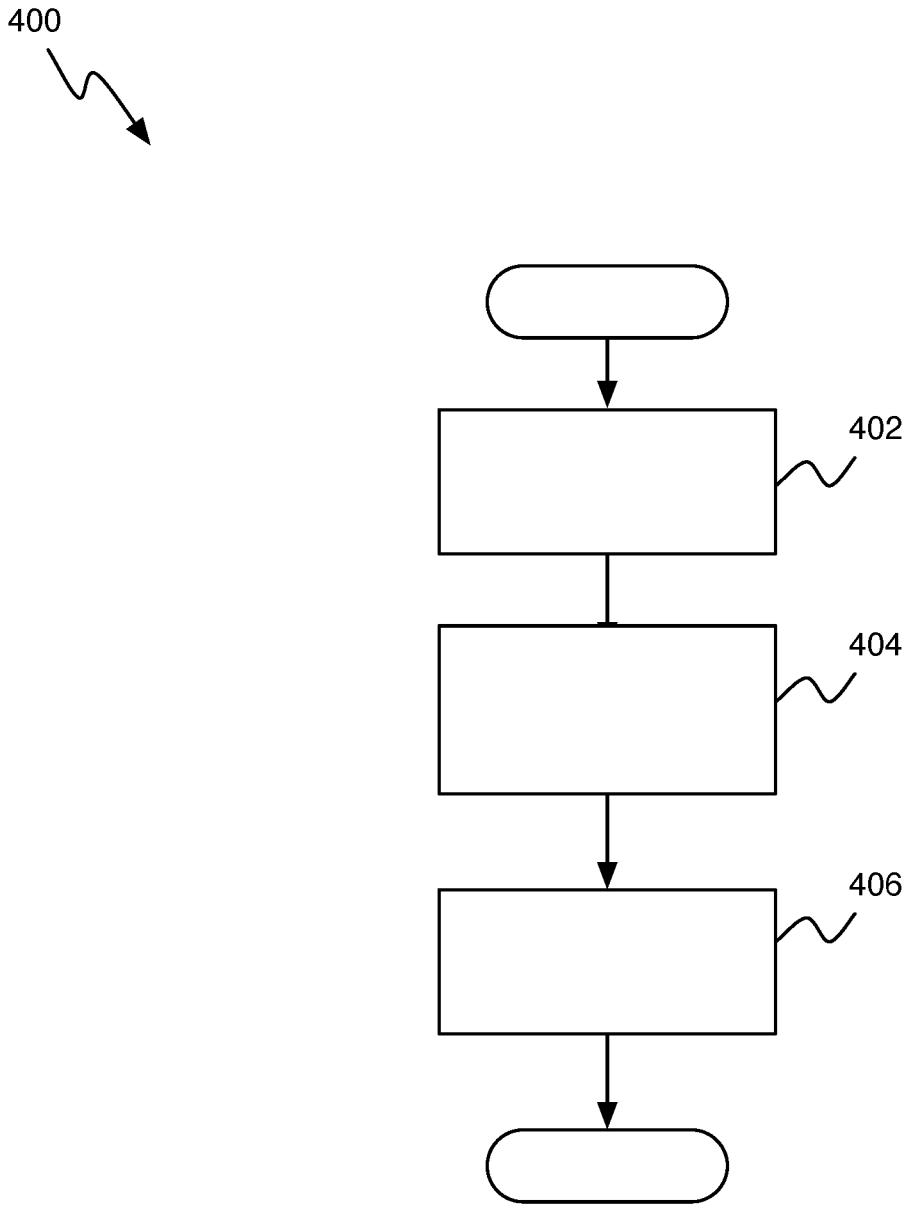
FIG. 4 shows a process for package waste management, in accordance with one embodiment.

In order to address this uncertainty, in accordance with the various embodiments of the invention, the waste event is not expressed as a specific package number, but rather as a distance in millimeters (or some other standardized length unit) from the position of the jaw system where the package array is shifted to various points in the filling machine 100 where waste events may occur. FIG. 4 shows a process 400 for package waste management in accordance with one embodiment.

As can be seen in FIG. 4, the process starts by detecting a waste event during normal operation of the filling machine

100, step 402. The waste event is associated with a waste event detection point in the filling machine 100 and a corresponding position on the web segment. Next, the process identifies one or more filled packages to be discarded, step 404. In the illustrated embodiment, the identification is made based on a predetermined distance along the path to be traversed by the web from the waste event detection point to the waste chute 200 of the filling machine, and that distance is expressed in a standardized length format, such as millimeters or centimeters.

In some embodiments, the position of the jaw system 110*a-b* in relation to the "shift position" Is also considered. For example, when a waste event occurs, a determination will be made that the package that is currently 700 mm away from the waste gate (i.e., the predetermined distance from the location of the waste event), but only if the encoder is in position 180. If the encoder position is less than 180 degrees, x mm is added to the predetermined distance, and if the encoder position is more than 180 degrees, the length is reduced by y mm. Again, using the example of FIGS. 3B and 3C described above, when the encoder position is at 181 degrees, the calculation would result in 700 mm−(359/360)× 200 mm=500.5 mm, meaning that the waste event would have been written to package 2 instead of 3 in the shifted array of FIG. 3C, which is correct, since the array was just shifted.

Finally, when the web segment position has advanced a distance equaling the predetermined distance, the filling machine 100 ejects one or more packages formed at, or in close proximity to, the web segment position, step 406, which ends the process 400. Thus, as a result of this more accurate determination, it is possible to know with greater certainty which package should be discarded, and a significant reduction in wasted packages from the filling machine 100 may be achieved. Furthermore, since the distances within the filling machine 100 have been predetermined, either through manual measuring, through measuring on a CAD drawing of the filling machine, or a combination of both, the calibration of a new filling machine (100) or adjustment of an existing filling machine (100) to produce a different type of packages is greatly simplified.

It should be noted that there are many variations to the above examples which fall within the scope of the appended claims. While the examples presented herein has used an encoder position expressed in the range of 0-360 degrees, it should be noted that it can also be expressed in any unit, such as millimeter or centimeter. Thus, many variations may be envisioned by those having ordinary skill in the art. The systems and methods disclosed herein may be implemented as software, firmware, hardware or a combination thereof. In a hardware implementation, the division of tasks between functional units or components referred to in the above description does not necessarily correspond to the division into physical units; on the contrary, one physical component may perform multiple functionalities, and one task may be carried out by several physical components in collaboration.

Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which may be used to store the desired information and which may be accessed by a computer.

The flowchart and block diagrams in the figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, may be implemented by special purpose hardware-based systems that perform the specified functions or acts or carry out combinations of special purpose hardware and computer instructions.

It will be appreciated that a person skilled in the art may modify the above-described embodiments in many ways and still use the advantages of the invention as shown in the embodiments above. Thus, the invention should not be limited to the shown embodiments but should only be defined by the appended claims. Additionally, as the skilled person understands, the shown embodiments may be combined.

What is claimed is:

1. A method for package waste management in a filling machine, the method comprising:

detecting a waste event during operation of the filling machine, the waste event being associated with a waste event detection point in the filling machine and a corresponding web segment position of a packaging material;

identifying one or more filled packages to be discarded based on a predetermined distance along a path to be traversed by the packaging material from the waste event detection point to a waste chute of the filling machine, wherein the predetermined distance is expressed in a standardized length measurement format;

determining that the web segment position has progressed a distance equaling the predetermined distance; and in response to determining that the web segment position has progressed the distance equaling the predetermined distance, ejecting, through the waste chute, the one or more filled packages formed at or in close proximity to the web segment position;

wherein the predetermined distance is measured either manually in the filling machine or measured automatically using image data generated by a processor.

2. The method of claim 1, wherein the filling machine is a food product filling machine.

3. The method of claim 1, wherein the standardized length measurement format is either millimeters or centimeters.

4. The method of claim 1, wherein the filling machine comprises a plurality of modules, and wherein independent waste event detection points are included in one or more of the plurality of modules.

5. The method of claim 4, wherein the predetermined distance is calculated as a sum of distances within each module of the plurality of modules that the packaging material passes through from the waste event detection point to the waste chute.

6. The method of claim 1, wherein the image data generated by the processor comprises computer aided design (CAD) drawings.

7. The method of claim 1, further comprising:

determining whether to eject one or more packages based on a location of the web segment position with respect to a previous filled package or a subsequent filled package.

8. The method of claim 1, wherein determining that the web segment position has progressed the distance equaling the predetermined distance is made based on data obtained from an encoder in the filling machine.

9. The method of claim 8, wherein identifying the one or more filled packages to be discarded comprises:

determining a correction factor to be applied to the predetermined distance, wherein the correction factor is based on data obtained from the encoder.

10. A non-transitory computer readable storage medium storing instructions that, when executed to a processor, cause the processor to carry out the method according to claim 1.

11. A package waste management system in a filling machine comprising:

a memory; and a processor, wherein the memory stores instructions that when executed by the processor cause the processor to:

detect a waste event during operation of the filling machine, the waste event being associated with a waste event detection point in the filling machine and a corresponding web segment position of a packaging material;

identify one or more filled packages to be discarded based on a predetermined distance along a path to be traversed by the packaging material from the waste event detection point to a waste chute of the filling machine, and wherein the predetermined distance is expressed in a standardized length measurement format;

determine that the web segment position has progressed a distance equaling the predetermined distance; and in response to determining that the web segment position has progressed the distance equaling the predetermined distance, eject, through the waste chute, the one or more filled packages formed at or in close proximity to the web segment position;

wherein the predetermined distance is measured either manually in the filling machine or measured automatically using image data generated by the processor.

12. The package waste management system of claim 11, wherein the filling machine is a food product filling machine.

13. The package waste management system of claim 11, wherein the standardized length measurement format is either millimeters or centimeters.

14. The package waste management system of claim 11, wherein the filling machine comprises a plurality of modules, and wherein independent waste event detection points are included in one or more of the plurality of modules.

15. The package waste management system of claim 14, wherein the predetermined distance is calculated as a sum of distances within each module of the plurality of modules that the packaging material passes through from the waste event detection point to the waste chute.

16. The package waste management system of claim 11, wherein the image data generated by the processor comprises computer aided design (CAD) drawings.

17. The package waste management system of claim 11, wherein the memory further stores instructions that when executed by the processor causes the processor to:

determine whether to eject one or more packages based on a location of the web segment position with respect to a previous filled package or a subsequent filled package.

18. The package waste management system of claim 11, wherein the instructions to determine that the web segment position has progressed the distance equaling the predetermined distance is made based on data obtained from an encoder in the filling machine.

19. The package waste management system of claim 18, wherein the instruction to identify the one or more filled packages to be discarded comprises to:

determine a correction factor to be applied to the predetermined distance, wherein the correction factor is based on data obtained from the encoder.

* * * * *